US006758258B1

(12) United States Patent
Nien

(10) Patent No.: US 6,758,258 B1
(45) Date of Patent: Jul. 6, 2004

(54) CENTER OF GRAVITY ADJUSTABLE BOTTOM RAIL FOR WINDOW BLIND ASSEMBLY

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/441,110

(22) Filed: May 20, 2003

(30) Foreign Application Priority Data

Apr. 9, 2003 (TW) ..... 92205679 U

(51) Int. Cl.[7] ..... E06B 9/30
(52) U.S. Cl. ..... 160/173 R; 160/178.1 R
(58) Field of Search ..... 160/173 R, 84.04, 160/84.05, 121.1, 168.1 R, 178.1 R

(56) References Cited

U.S. PATENT DOCUMENTS 3,280,890 A * 10/1966 Preziosi ..... 160/168.1 R
5,176,192 A * 1/1993 Judkins et al. ..... 160/84.04
6,412,537 B1 * 7/2002 Voss et al. ..... 160/84.05
6,546,989 B2 * 4/2003 Coleman et al. ..... 160/173 R
6,550,522 B1 * 4/2003 Lennon et al. ..... 160/168.1 R

* cited by examiner

*Primary Examiner*—David Purol
(74) *Attorney, Agent, or Firm*—Browdy and Neimark, P.L.L.C.

(57) ABSTRACT

A center of gravity adjustment device installed in a bottom rail of a window blind assembly for adjusting the center of gravity of the bottom rail is disclosed to include an adjustment wheel fastened rotatably with the bottom rail for rotating by a user, a rotating wheel fastened rotatably with the bottom rail and spaced from the adjustment wheel at a distance, a weight movable in the bottom rail between the adjustment wheel and the rotating wheel, and a cord member mounted around the adjustment wheel and the rotating wheel and fastened to the weight for moving the weight in said bottom rail between the adjustment wheel and the rotating wheel upon rotation of the adjustment wheel.

10 Claims, 7 Drawing Sheets

CENTER OF GRAVITY ADJUSTABLE BOTTOM RAIL FOR WINDOW BLIND ASSEMBLY

BACKGROUND OF THE INVENTION

1. Field of the Invention

The present invention relates generally to lifting window blinds (roll-up blinds, Venetian blinds) and, more specifically, to a center of gravity adjustable bottom rail for window blind. The invention relates to also to a window blind assembly having a center of gravity adjustable bottom rail.

2. Description of the Related Art

FIG. 7 shows a roller blind 90 according to the prior art. This structure of roller blind 90 comprises a barrel 91 fastened pivotally with the top of a window (not shown) in transverse direction, a bottom rail 92 arranged in parallel to and spaced below the barrel 91, flexible slats 93 arranged in parallel between the barrel 91 and the bottom rail 91, two thin covering sheets 95 respectively covering the slats 93 at front and back sides and connected between the barrel 91 and the bottom rail 92 to join the slats 93. The covering sheets 95 soften the light passing through the window blind assembly 90. The user can rotate the barrel 91 (manually or by a motor drive) to roll up the slats 93 and the covering sheets 95 around the periphery of the barrel 91.

The aforesaid roller blind 90 is still not satisfactory in function. Because it is difficult to keep the tension of each covering sheet 95 (which is usually a piece of meshed fabric) in balance at left and right sides, the bottom rail 92 cannot be maintained in horizontal accurately. During fabrication and assembly process of the bottom rail 92 (which is comprised of an aluminum profile and two plastic end caps at two ends of the aluminum profile), it is difficult to have the gravity weight evenly distributed in all directions. When installed in the covering sheets 95, the bottom rail 92 may not be maintained in horizontal accurately. When the bottom rail 92 lifted to a relatively higher position close to the barrel 91, it stands in an oblique position sloping downwards toward one lateral side of the blind (see FIG. 8), obstructing the sense of beauty of the roller blind 90.

SUMMARY OF THE INVENTION

The present invention has been accomplished under the circumstances in view. It is the main object of the present invention to provide a center of gravity adjustment device, which is practical for use in a window blind assembly, such as a roll-up blind, lifting-type blind, etc., for enabling the user to adjust the center of gravity of the bottom rail to keep the bottom rail in horizontal.

It is another object of the present invention to provide a window blind assembly having a center of gravity adjustable bottom rail, which enables the user to adjust the center of gravity of the bottom rail, keeping the bottom rail in horizontal.

To achieve these objects of the present invention, a center of gravity adjustment device is installed in a bottom rail of a window blind assembly for adjusting the center of gravity of the bottom rail, comprising an adjustment wheel fastened rotatably with the bottom rail for rotating by a user, a rotating wheel fastened rotatably with the bottom rail and spaced from the adjustment wheel at a distance, a weight movable in the bottom rail between the adjustment wheel and the rotating wheel, and a cord member mounted around the adjustment wheel and the rotating wheel and fastened to the weight for moving the weight in said bottom rail between the adjustment wheel and the rotating wheel upon rotation of the adjustment wheel.

DETAILED DESCRIPTION OF THE INVENTION

Figure 1:
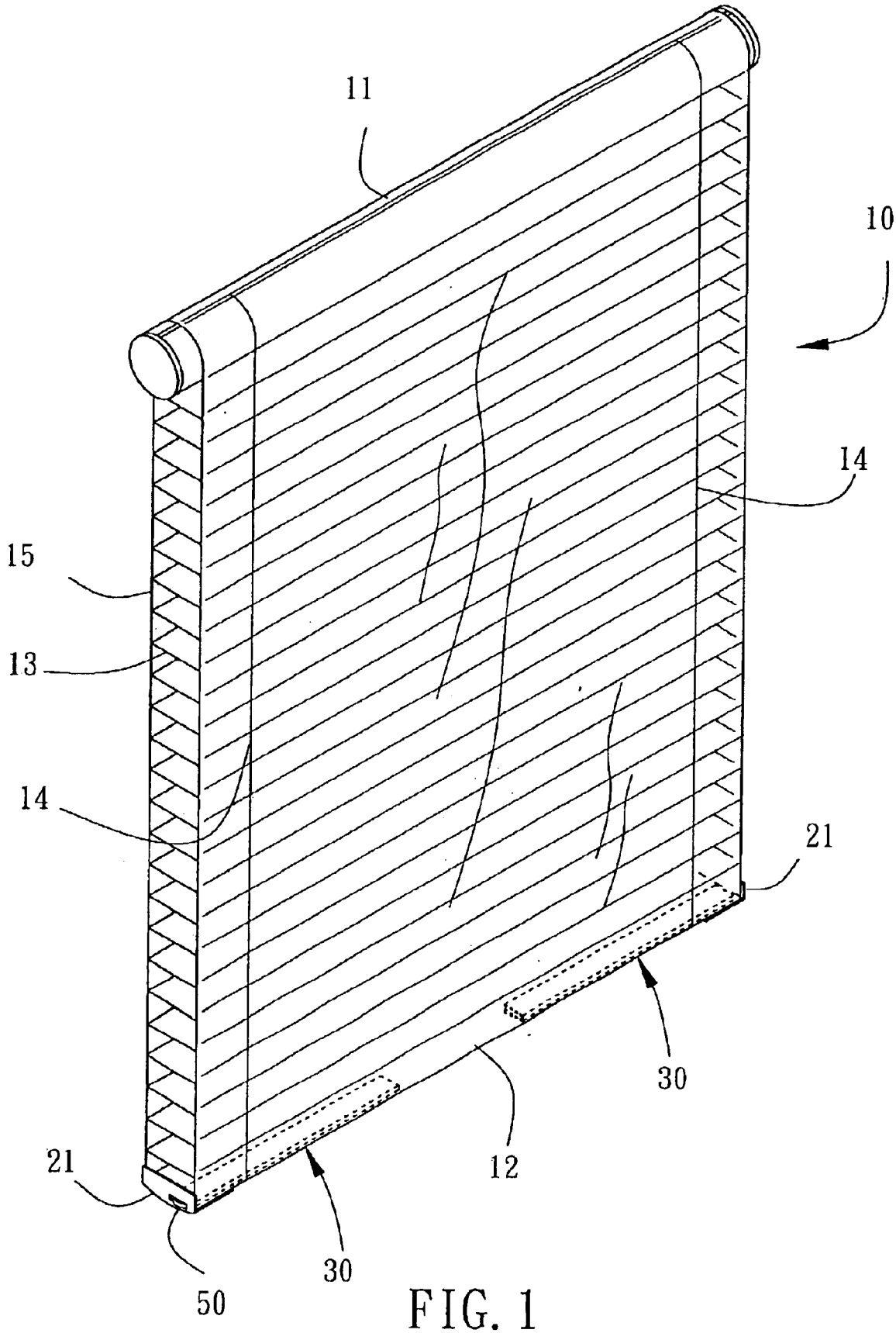
FIG. 1 is a perspective view of a window blind assembly constructed according to a preferred embodiment of the present invention.

Referring to FIG. 1, a window blind assembly 10 in accordance with the present invention is shown comprised of a barrel 11 fastened pivotally with the top side of a window (not shown), a bottom rail 12 arranged in parallel to and spaced below the barrel 11, a plurality of flexible slats 13 arranged in parallel between the barrel 11 and the bottom rail 12, two ladder tapes 14 bilaterally and vertically connected between the barrel 11 and the bottom rail 12 and joining the slats 13, and a flexible covering sheet 15. The covering sheet 15 has a first half disposed at the front side of the slats 13, a second half disposed at the back side of the slats 13, and a middle part connected between the first half and the second half below the bottom rail 12. The top sides of the first and second halves of the covering sheet 15 are respectively connected to the barrel 11. Because the aforesaid basic structure of the window blind assembly is not within the scope of the claims of the present invention, no further detailed description in this regard is necessary.

Figure 2:
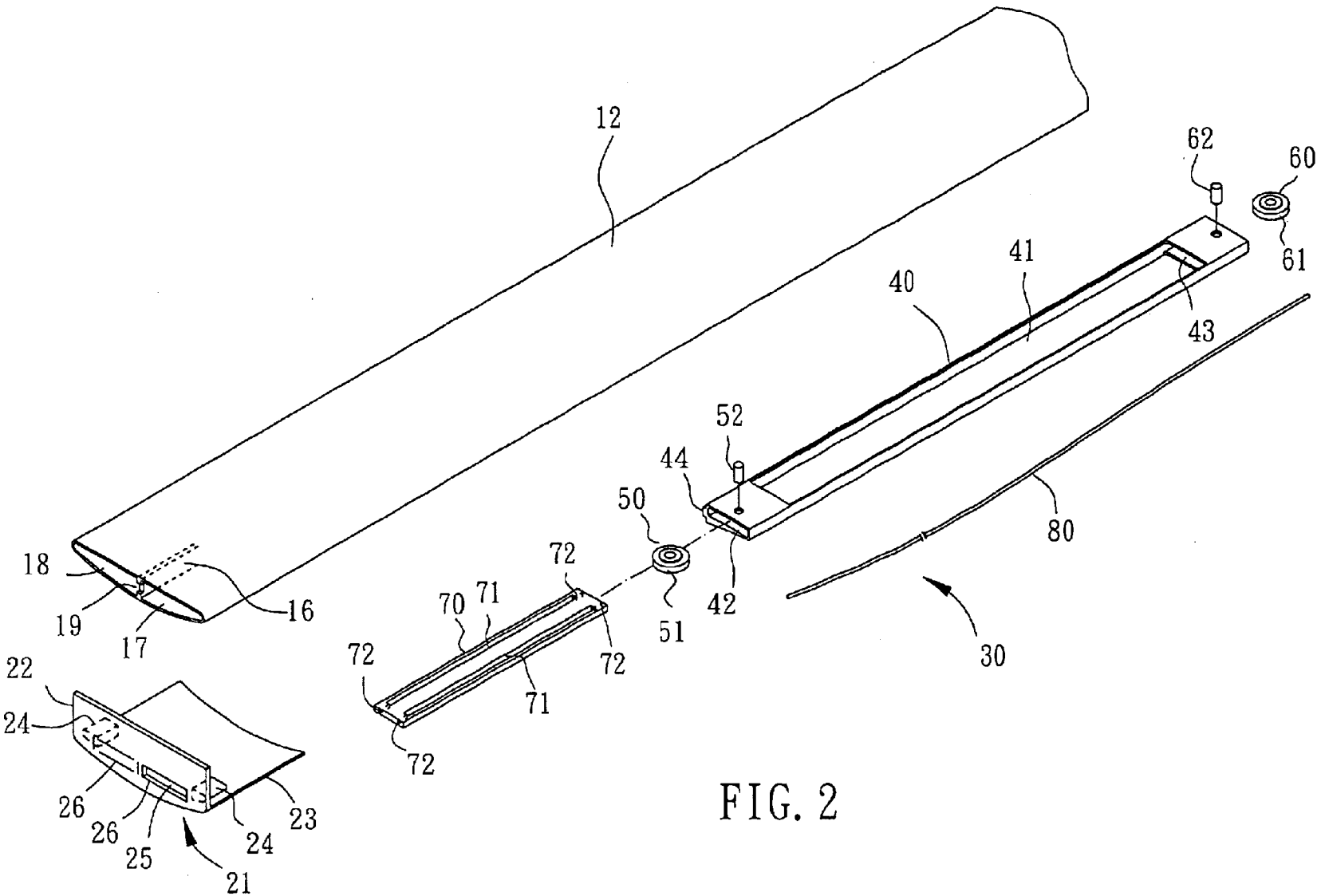
FIG. 2 is an exploded view, in an enlarged scale, of the bottom rail of the window blind assembly shown in FIG. 1.

Referring to FIG. 2 and FIG. 1 again, the main feature of the present invention is at the bottom rail 12. The bottom rail 12 is a hollow elongated flat member extruded from aluminum, having a flat top surface, a convex bottom surface, and a longitudinally extended middle partition wall 16. The partition wall 16 divides the internal space of the bottom rail 12 a longitudinally extended front chamber 17 and a longitudinally extended back chamber 18. Further, the partition wall 16 has two end notches 19 respectively formed in the two distal ends on the middle.

Figure 3:
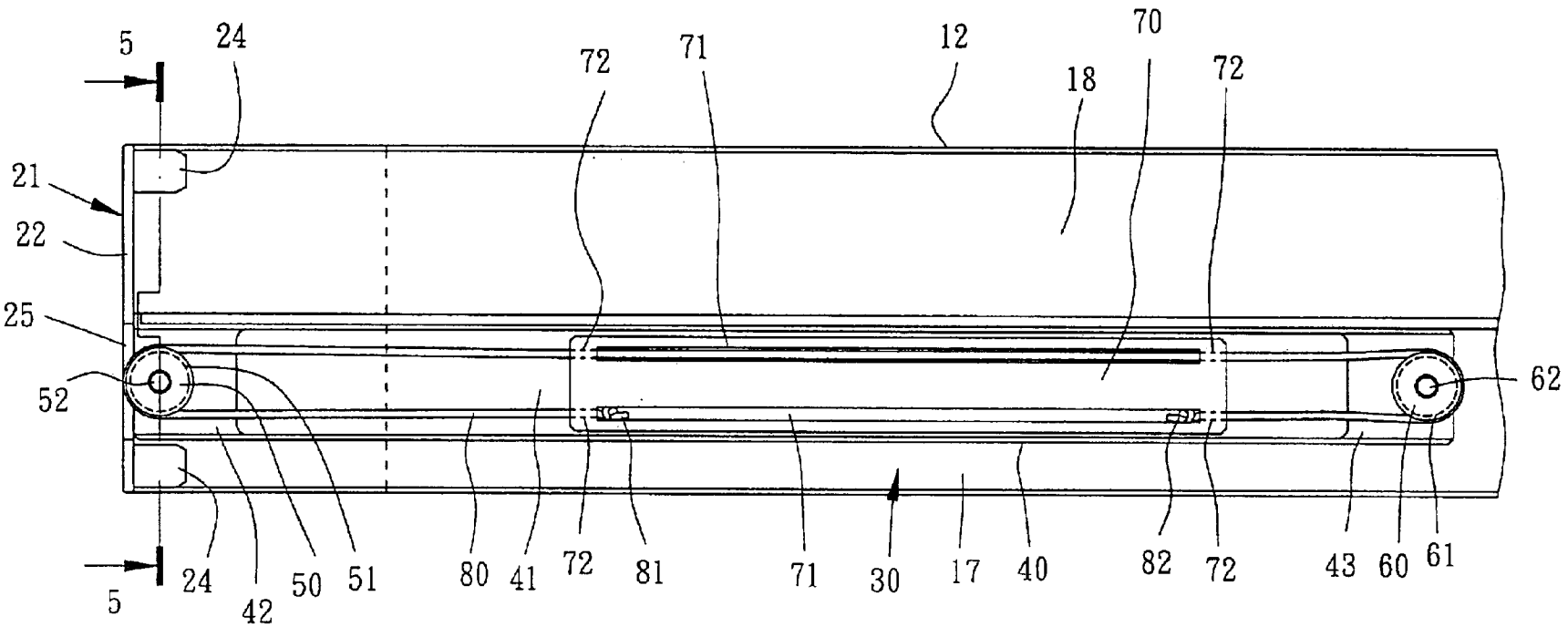
FIG. 3 is a top view, partially in section, of the bottom rail according to the present invention.
Figure 4:
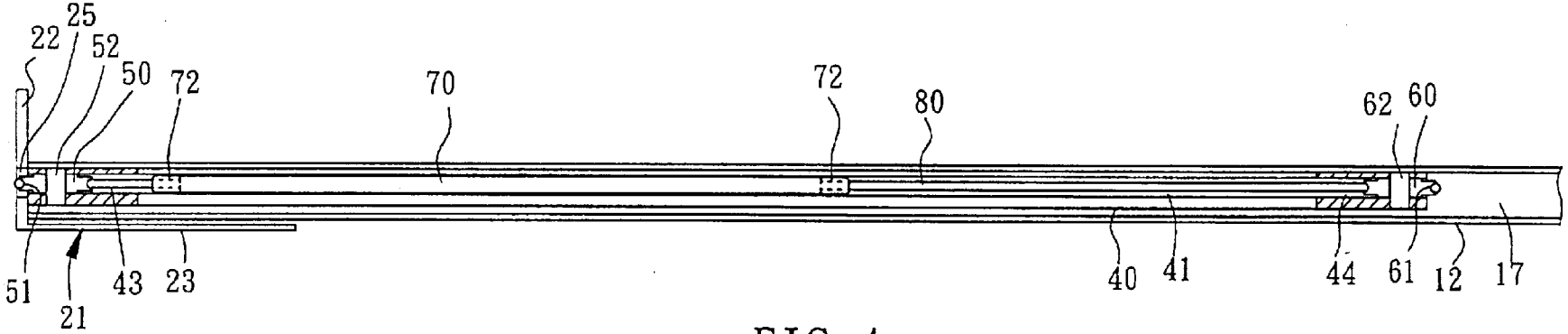
FIG. 4 is a front view, partially in section, of the bottom rail according to the present invention.
Figure 5:
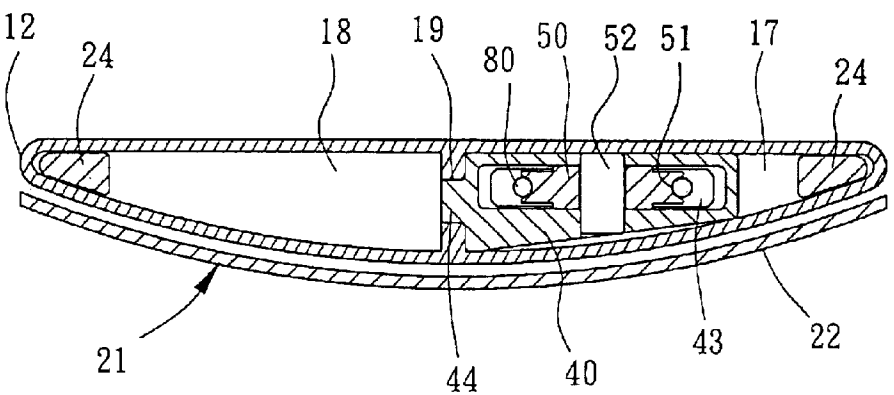
FIG. 5 is a sectional view taken along line 5—5 of FIG. 3.
Figure 6:
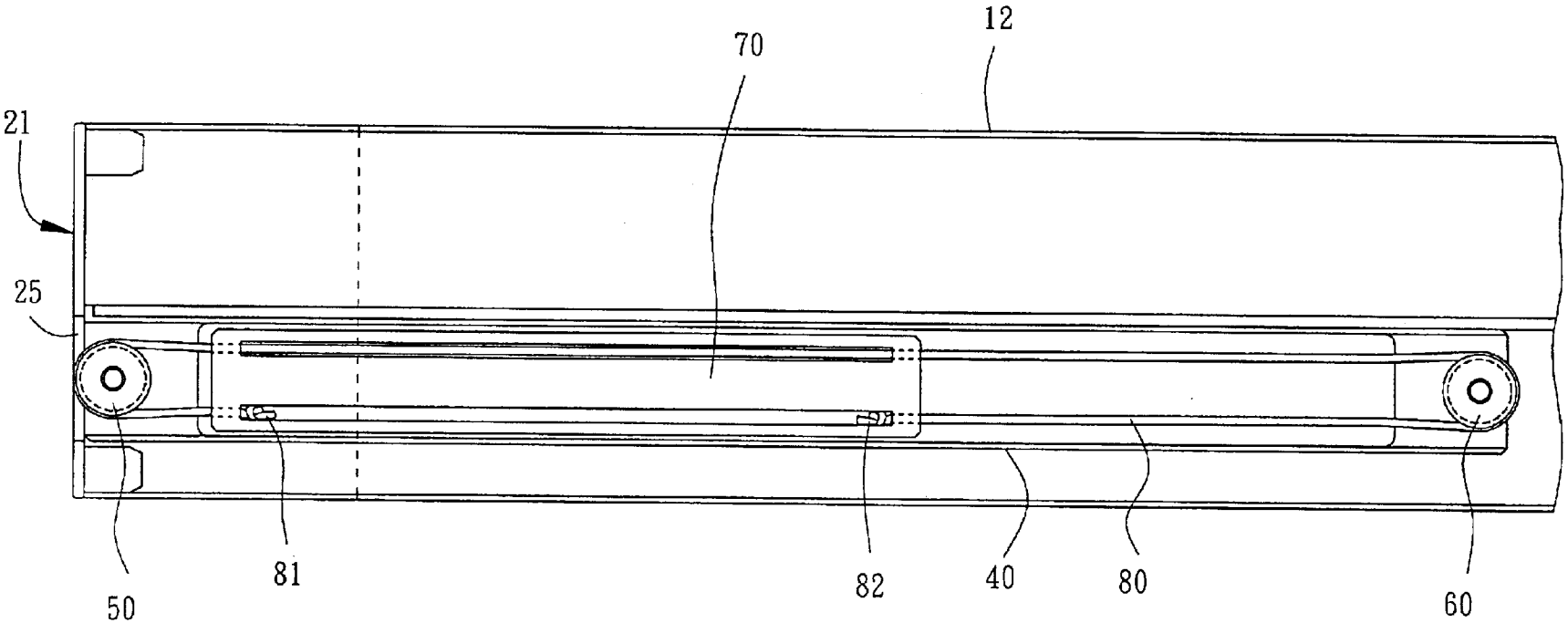
FIG. 6 is similar to FIG. 3 but showing the position of the weight changed.
Figure 7:
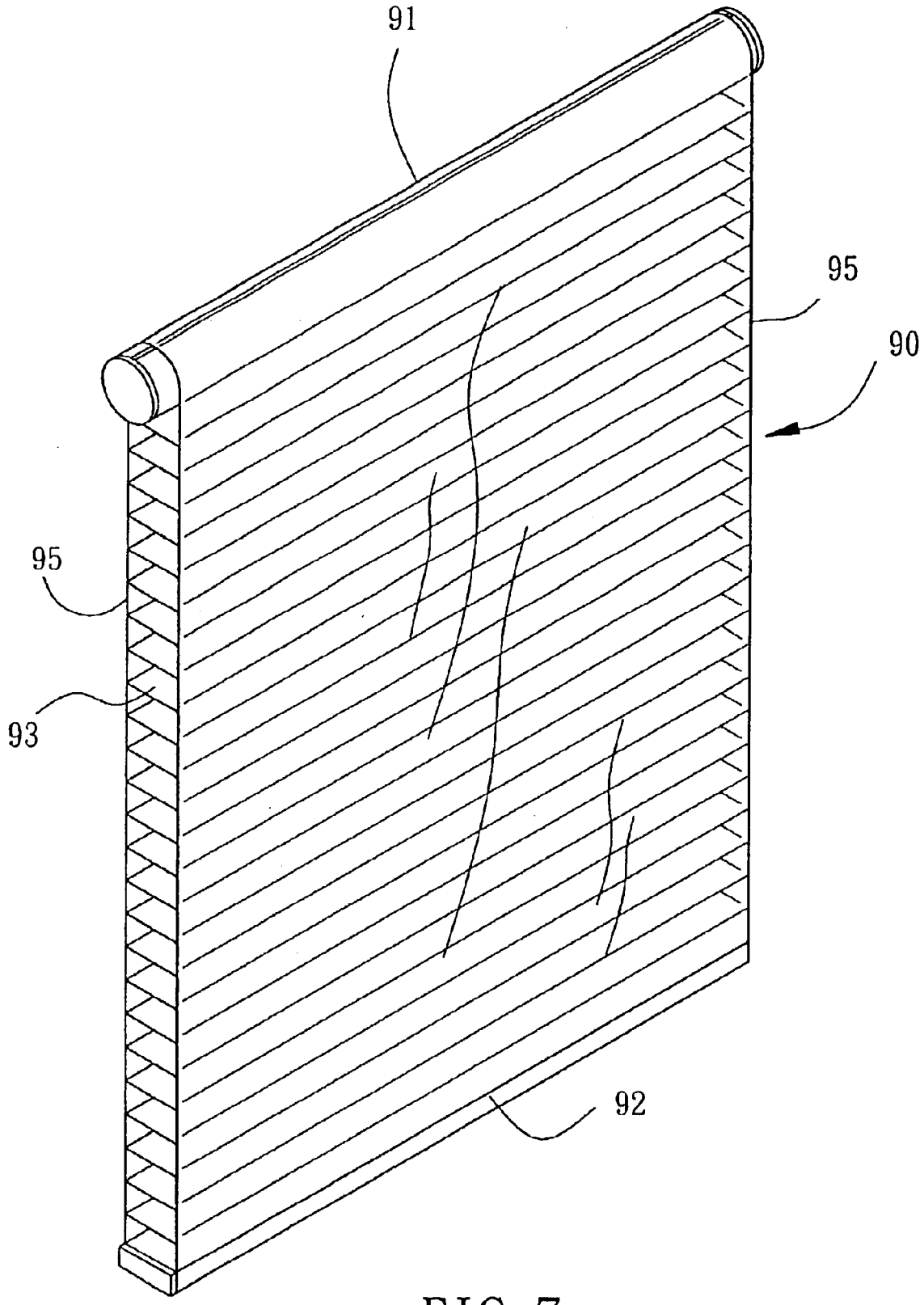
FIG. 7 PRIOR ART
FIG. 7 shows a roller blind according to the prior art.
Figure 8:
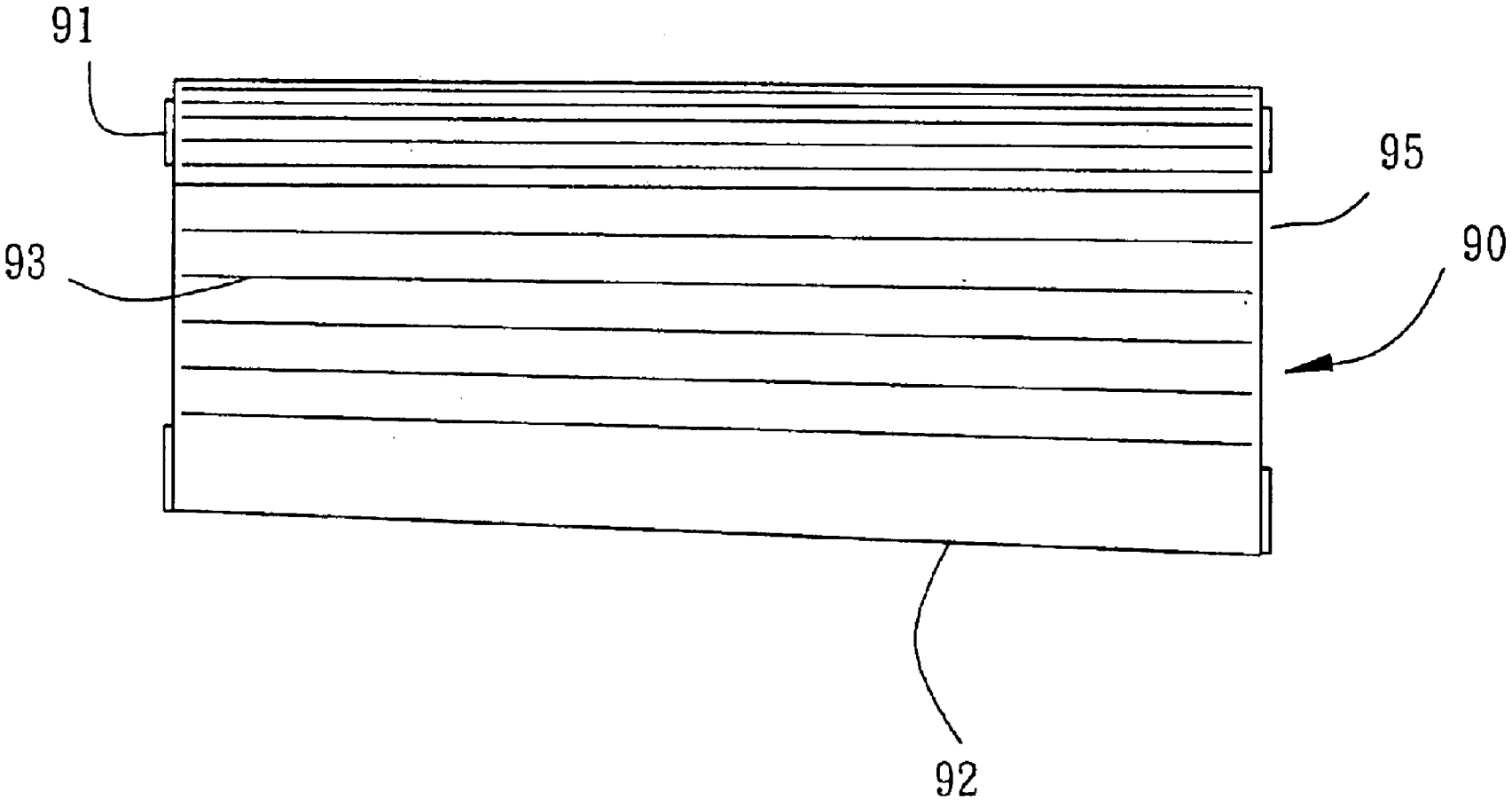
FIG. 8 PRIOR ART
FIG. 8 is a schematic view showing the bottom rail lifted to a relatively higher position close to the barrel of the prior art roller blind shown in FIG. 7.

Referring to FIGS. 3~5 and FIGS. 1 and 2 again, two end caps 21 are respectively fastened to the two ends of the bottom rail 12. The end caps 21 are L-shaped cover members respectively injection-molded from plastics, each having a vertical wall 22 and a horizontal wall 23 connected at right angles, and two insertion blocks 24 bilaterally perpendicularly extended from the vertical wall 22 and suspending above the horizontal wall 23. By mans of plugging the insertion blocks 24 into the longitudinally extended front chamber 17 and longitudinally extended back chamber 18 of the bottom rail 12, the end caps 21 are fastened to the ends of the bottom rail 12. When the end caps 21 installed, the vertical walls 22 of the end caps 21 close the ends of the bottom rail 12, and the horizontal walls 23 of the end caps 21 are suspended below the bottom rail 12 and spaced from the bottom surface of the bottom rail 12 at a distance (for the passing of the covering sheet 15). Further, the vertical wall 22 of each end cap 21 has a horizontally extended elongated slot 25 corresponding to the longitudinally extended front chamber 17 of the bottom rail 12. In order to save manufacturing cost, the end caps 21 are made having two frames of line formed of dents and disposed in the respective vertical wall 22 corresponding to the longitudinally extended front chamber 17 and the longitudinally extended back chamber 18. Therefore, the user can remove the area within one frame of line and keep the area within the other frame of line intact. By means of selectively piercing one frame of line, a horizontally extended elongated slot 25 is formed in each end cap 21 corresponding to the longitudinally extended front chamber 17.

As illustrated in FIG. 1, two identical center of gravity adjustment devices 30 are symmetrically mounted in the two ends of the bottom rail 12. FIGS. 2~6 show only one center of gravity adjustment device 30. Each center of gravity adjustment device 30 comprises a track 40, an adjustment wheel 50, a rotating wheel 60, a weight 70, and a cord member 80.

The track 40 is an elongated flat bar having a longitudinally extended center opening 41, two end holes 42 and 43 formed in the two ends in communication with the center opening 41, and a retaining portion 44 protruded from one end. The track 40 is inserted into the longitudinally extended front chamber 17 of the bottom rail 12 to engage the retaining portion 44 into one end notch 19 of the partition wall 16. When the retaining portion 44 engaged into one end notch 19 of the partition wall 16, the track 40 is set in position and maintained in flush with one end of the bottom rail 12.

The adjustment wheel 50 is a flat circular wheel having an endless groove 51 around the periphery. The surface of the endless groove 51 is coarsened or embossed with a pattern (not shown). The adjustment wheel 50 is pivotally mounted in the outer end hole 42 of the track 40 by a pin 52. When installed, the adjustment wheel 50 has a part disposed outside the outer end of the track 40 (i.e., outside one end of the bottom rail 12) and projecting out of the elongated slot 25 of the corresponding end cap 21. Therefore, the user can rotate the adjustment wheel 50 with the thumb conveniently.

The rotating wheel 60 is same as the adjustment wheel 50 in shape, having an endless groove 61 around the periphery. The rotating wheel 60 is pivotally mounted in the inner end hole 42 of the track 40 by a pin 62.

The weight 70 is an elongated flat heavy metal plate smaller than the longitudinally extended center opening 41 of the track 40, having two longitudinal slots 71 cut through the top and bottom sides and arranged in parallel, and two pairs of end holes 72 aligned in the two ends in communication with the longitudinal slots 71. The weight 70 is longitudinally movably suspended in the longitudinally extended center opening 41 of the track 40.

The cord member 80 is mounted around the endless groove 51 of the adjustment wheel 50 and the endless groove 61 of the rotating wheel 60 and inserted through the back end holes 72 of the weight 70 and the corresponding longitudinal slot 71, having two ends respectively inserted through the front end holes 72 of the weight 70 into the corresponding longitudinal slot 71 and then respectively tied in a knot 81 or 82. The two knots 81 and 82 of the cord member 80 are respectively stopped in connection areas between the front end holes 72 of the weight 70 and the corresponding longitudinal slot 71. The friction resistance between the wheels 50 and 60 and the cord member 80 enables the cord member 80 to be moved to carry the weight 70 leftwards or rightwards upon rotary motion of the adjustment wheel 50. For example, when the user rotating the adjustment wheel 50 clockwise, the cord member 80 is turned with the adjustment wheel 50, thereby causing the left knot 81 to pull the weight 70 leftwards (at the same time, the right knot 82 pushes the weight 70 leftwards) to the position shown in FIG. 6.

The aforesaid description explains the structure and function of the bottom rail 12. During installation, the adjustment wheel 50 and the rotating wheel 60 are respectively pivotally mounted in the two ends of the track 40 at first, and then the weight 70 is put in the longitudinally extended center opening 41 of the track 40, and then one end of the cord member 80 is tied in a knot 82, and then the other end of the cord member 80 is inserted from the front longitudinal slot 71 of the weight 70 through one front end hole 72 of the weight 70 and then extended over the endless groove 61 of the rotating wheel 60 and inserted through the back end holes 72 and back longitudinal slot 71 of the weight 70 and then extended over the endless groove 51 of the adjustment wheel 50 and then inserted through the other front end hole 72 of the weight 70 into the longitudinally extended center opening 41 of the track 40 and then tied in a knot 81. Thereafter, the two center of gravity adjustment devices 30 are respectively mounted in the bottom rail 12, and then the end caps 21 are fastened to the ends of the bottom rail 12.

When the bottom rail 12 installed in the window blind assembly 10, the user can rotate the adjustment wheel 50 of each center of gravity adjustment device 30 to adjust the position of the respective weight 70 in the respective track 40, so as to further adjust the center of gravity of the bottom rail 12, keeping the bottom rail 12 in horizontal accurately. For example, if the bottom rail 12 sloping downwards from the left side toward the right sight, the user can rotate the adjustment wheel 50 of the left center of gravity adjustment device 30 to adjust the position of the respective weight 70 leftwards (the user may adjust the two center of gravity adjustment devices 30 if necessary), so as to further shift the center of gravity of the bottom rail 12 leftwards, enabling the bottom rail 12 to be held in horizontal.

According to the aforesaid embodiment of the present invention, the center of gravity adjustment devices 30 are mounted in the bottom rail 12 near the front side of the bottom rail 12. When the user rotating the barrel 11 to roll up the covering sheet 15 and the slats 13, the bottom rail 12 is gradually turned from a horizontal position to a vertical position, i.e., the back side of the bottom rail 12 is gradually turned upwards and the front side of the bottom rail 12 is gradually turned downwards. Because the center of gravity adjustment devices 30 are mounted in the bottom rail 12 near the front side of the bottom rail 12, the center of gravity of the bottom rail 12 can smoothly be shifted to the bottom side to stretch the cover sheet 15 when turned from the horizontal position to the vertical position.

While only one embodiment of the present invention has been shown and described, it will be understood that various modifications and changes could be made thereunto without departing from the spirit of the invention. For example, the bottom rail can be made having only one center of gravity adjustment device on the middle for adjustment, and the center of gravity adjustment device of the present invention can be installed in the bottom rail of any type of window blind assembly, such as roller blind, Venetian blind, pleated blind, etc. Accordingly, the invention is not to be limited except as by the appended claims.

What is claimed is:

1. A center of gravity adjustment device for a bottom rail of a window blind assembly, comprising:

an adjustment wheel fastened rotatably with said bottom rail for rotating by a user;

a rotating wheel fastened rotatably with said bottom rail and spaced from said adjustment wheel at a distance;

a weight movable in said bottom rail between said adjustment wheel and said rotating wheel; and a cord member mounted around said adjustment wheel and said rotating wheel and fastened to said weight for moving said weight in said bottom rail between said adjustment wheel and said rotating wheel upon rotation of said adjustment wheel.

2. The center of gravity adjustment device as claimed in claim 1, further comprising a hollow elongated track mounted inside said bottom rail and adapted to accommodate said adjustment wheel, said rotating wheel, said weight and said cord member.

3. The center of gravity adjustment device as claimed in claim 2, wherein said track has a longitudinally extended center opening, and two end holes in two ends thereof in communication with said center opening; said adjustment wheel and said rotating wheel are respectively rotatably mounted in the end holes of said track, and said adjustment wheel has a part projecting out of said track; said weight is movable in said center opening of said track between said adjustment wheel and said rotating wheel.

4. The center of gravity adjustment device as claimed in claim 1, wherein said weight is an elongated heavy plate member having a front longitudinal slot and a rear longitudinal slot respectively cut through top and bottom sides thereof and arranged in parallel, and a front pair of end holes and a rear pair of end holes aligned in two ends thereof in communication with said front longitudinal slot and said rear longitudinal slot; said cord member is inserted through said rear longitudinal slot and said rear pair of end holes of said weight, having two ends respectively inserted through said front end holes of said weight into said front longitudinal slot and tied in a respective knot.

5. A window blind assembly having at least one center of gravity adjustment device installed in a bottom rail thereof and adapted for adjusting the center of gravity of said bottom rail, said at least one center of gravity adjustment device each comprising:

an adjustment wheel fastened rotatably with said bottom rail for rotating by a user;

a rotating wheel fastened rotatably with said bottom rail and spaced from said adjustment wheel at a distance;

a weight movable in said bottom rail between said adjustment wheel and said rotating wheel; and a cord member mounted around said adjustment wheel and said rotating wheel and fastened to said weight for moving said weight in said bottom rail between said adjustment wheel and said rotating wheel upon rotation of said adjustment wheel.

6. The window blind assembly as claimed in claim 5, wherein said at least one center of gravity adjustment device each further comprises a hollow elongated track mounted inside said bottom rail and adapted to accommodate the adjustment wheel, rotating wheel, weight and cord member of the respective center of gravity adjustment device.

7. The window blind assembly as claimed in claim 6, wherein said track has a longitudinally extended center opening, and two end holes in two ends thereof in communication with said center opening; said adjustment wheel and said rotating wheel are respectively rotatably mounted in the end holes of the track of the respective center of gravity adjustment device, and said adjustment wheel has a part projecting out of the track of the respective center of gravity adjustment device; said weight is movable in the center opening of the track of the respective center of gravity adjustment device between the adjustment wheel and rotating wheel of the respective center of gravity adjustment device.

8. The window blind assembly as claimed in claim 5, wherein said weight is an elongated heavy plate member having a front longitudinal slot and a rear longitudinal slot respectively cut through top and bottom sides thereof and arranged in parallel, and a front pair of end holes and a rear pair of end holes aligned in two ends thereof in communication with said front longitudinal slot and said rear longitudinal slot; said cord member is inserted through the rear longitudinal slot and rear pair of end holes of the weight of the respective center of gravity adjustment device, having two ends respectively inserted through the front end holes of the weight of the respective center of gravity adjustment device into the front longitudinal slot of the weight of the respective center of gravity adjustment device and tied in a respective knot.

9. The window blind assembly as claimed in claim 5, wherein the number of said at least one center of gravity adjustment device is 2, and the two center of gravity adjustment devices are installed in two distal ends of said bottom rail.

10. The window blind assembly as claimed in claim 5, wherein the adjustment wheel of each of said at least one center of gravity adjustment device is partially peripherally disposed outside said bottom rail for operation by the user.

* * * * *